US009046837B2

(12) United States Patent
Ikebuchi et al.

(10) Patent No.: US 9,046,837 B2
(45) Date of Patent: Jun. 2, 2015

(54) FIXING DEVICE AND METHOD, AND IMAGE FORMING APPARATUS INCORPORATING SAME

(75) Inventors: Yutaka Ikebuchi, Kanagawa (JP); Masaaki Yoshikawa, Tokyo (JP); Kenji Ishii, Kanagawa (JP); Yuji Arai, Kanagawa (JP); Hiromasa Takagi, Tokyo (JP); Naoki Iwaya, Tokyo (JP); Tetsuo Tokuda, Kanagawa (JP); Yoshiki Yamaguchi, Kanagawa (JP); Takuya Seshita, Kanagawa (JP); Takahiro Imada, Kanagawa (JP); Ippei Fujimoto, Kanagawa (JP); Hiroshi Yoshinaga, Chiba (JP); Hajime Gotoh, Kanagawa (JP); Arinobu Yoshiura, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 452 days.

(21) Appl. No.: 13/343,468

(22) Filed: Jan. 4, 2012

(65) Prior Publication Data

US 2012/0177393 A1 Jul. 12, 2012

(30) Foreign Application Priority Data

Jan. 7, 2011 (JP) ..... 2011-001841

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/69
See application file for complete search history.

(56) References Cited

U.S. PATENT DOCUMENTS

| | | | | |
|---|---|---|---|---|
| 3,989,370 | A * | 11/1976 | Mooney | 399/70 |
| 5,907,743 | A | 5/1999 | Takahashi | |
| 6,034,790 | A | 3/2000 | Kamei et al. | |
| 6,628,916 | B2 | 9/2003 | Yasui et al. | |
| 6,636,709 | B2 | 10/2003 | Furukawa et al. | |
| 6,778,790 | B2 | 8/2004 | Yoshinaga et al. | |
| 6,778,804 | B2 | 8/2004 | Yoshinaga et al. | |
| 6,785,505 | B2 | 8/2004 | Yasui et al. | |
| 6,813,464 | B2 | 11/2004 | Amita et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |

(Continued)

FOREIGN PATENT DOCUMENTS

| | | |
|---|---|---|
| EP | 0836123 | 4/1998 |
| JP | 05-224559 A | 9/1993 |

(Continued)

OTHER PUBLICATIONS

European Search Report dated Jun. 28, 2012 issued in corresponding European Application No. 12150030.0.

*Primary Examiner* — David Bolduc
(74) *Attorney, Agent, or Firm* — Harness, Dickey & Peirce, P.L.C.

(57) ABSTRACT

A fixing device includes a heater to generate heat based on soft-start control. The heater is supplied with power using different power-turn-on-duty control patterns in accordance with power requirements and an operation mode of the fixing device.

18 Claims, 8 Drawing Sheets

(56) References Cited

U.S. PATENT DOCUMENTS 6,900,419 B2 * 5/2005 Takagi et al. ..... 219/619
6,937,827 B2 8/2005 Katoh et al.
7,022,944 B2 4/2006 Yoshinaga et al.
7,054,570 B2 5/2006 Kishi et al.
7,116,923 B2 10/2006 Kishi et al.
7,127,204 B2 10/2006 Satoh et al.
7,130,555 B2 10/2006 Kishi et al.
7,151,907 B2 12/2006 Yoshinaga
7,209,675 B2 4/2007 Matsusaka et al.
7,212,758 B2 5/2007 Kishi et al.
7,212,759 B2 5/2007 Kishi et al.
7,239,821 B2 7/2007 Matsusaka et al.
7,239,838 B2 7/2007 Sato et al.
7,242,897 B2 7/2007 Satoh et al.
7,308,216 B2 12/2007 Kishi et al.
7,313,353 B2 12/2007 Satoh et al.
7,333,743 B2 2/2008 Kishi et al.
7,343,113 B2 3/2008 Matsusaka et al.
7,352,987 B2 4/2008 Iwata et al.
7,356,270 B2 4/2008 Matsusaka et al.
7,366,432 B2 4/2008 Kishi et al.
7,373,094 B2 5/2008 Kishi et al.
7,379,698 B2 5/2008 Yoshinaga
7,454,151 B2 11/2008 Satoh et al.
7,466,949 B2 12/2008 Satoh et al.
7,496,309 B2 2/2009 Matsusaka et al.
7,509,085 B2 3/2009 Yoshinaga et al.
7,515,845 B2 4/2009 Kishi et al.
7,546,049 B2 6/2009 Ehara et al.
7,551,869 B2 6/2009 Kishi et al.
7,565,087 B2 7/2009 Matsusaka et al.
7,570,910 B2 8/2009 Ishii
7,603,049 B2 10/2009 Kishi et al.
7,609,988 B2 10/2009 Kishi et al.
7,664,410 B2 2/2010 Takagi
7,675,010 B2 * 3/2010 Takagi et al. ..... 219/619
7,783,240 B2 8/2010 Ito et al.
7,796,933 B2 9/2010 Ueno et al.
7,801,457 B2 9/2010 Seo et al.
7,840,151 B2 11/2010 Fujimoto
7,885,569 B2 2/2011 Kishi et al.
7,912,392 B2 3/2011 Yoshinaga et al.
7,925,177 B2 4/2011 Ishii et al.
7,953,338 B2 5/2011 Takagi
7,957,663 B2 6/2011 Kishi et al.
7,983,598 B2 7/2011 Shinshi et al.
8,023,861 B2 9/2011 Yoshinaga et al.
8,064,798 B2 11/2011 Shinshi et al.
8,073,352 B2 12/2011 Kunii et al.
2002/0018663 A1 2/2002 Furukawa et al.
2002/0067936 A1 6/2002 Yasui et al.
2003/0000933 A1 1/2003 Yoshinaga et al.
2003/0002882 A1 * 1/2003 Takagi et al. ..... 399/69
2003/0007813 A1 1/2003 Yasui et al.
2003/0016963 A1 1/2003 Yoshinaga et al.
2003/0165348 A1 9/2003 Amita et al.
2003/0206758 A1 11/2003 Yasui et al.
2003/0215255 A1 * 11/2003 Kinouchi et al. ..... 399/69
2003/0215271 A1 11/2003 Yoshinaga et al.
2004/0013453 A1 1/2004 Shinshi et al.
2004/0245241 A1 12/2004 Kishi et al.
2004/0247332 A1 12/2004 Kishi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0123315 A1 6/2005 Kishi et al.
2005/0139584 A1 6/2005 Kishi et al.
2005/0163543 A1 7/2005 Satoh et al.
2005/0175368 A1 8/2005 Matsusaka et al.
2005/0175370 A1 8/2005 Matsusaka et al.
2005/0191078 A1 9/2005 Kishi et al.
2006/0029411 A1 2/2006 Ishii et al.
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0062609 A1 * 3/2006 Kinouchi et al. ..... 399/328
2006/0116230 A1 6/2006 Satoh et al.
2006/0127118 A1 6/2006 Kishi et al.
2006/0165429 A1 7/2006 Satoh et al.
2006/0165443 A1 7/2006 Yoshinaga et al.
2006/0165448 A1 7/2006 Yoshinaga
2006/0182460 A1 8/2006 Kishi et al.
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0025754 A1 2/2007 Takagi
2007/0031159 A1 2/2007 Kishi et al.
2007/0059062 A1 * 3/2007 Endo et al. ..... 399/329
2007/0071513 A1 * 3/2007 Kikuchi et al. ..... 399/323
2007/0212090 A1 9/2007 Matsusaka et al.
2008/0063443 A1 3/2008 Yoshinaga et al.
2008/0145088 A1 6/2008 Matsusaka et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0003867 A1 1/2009 Fujimoto
2009/0067902 A1 3/2009 Yoshinaga et al.
2009/0074442 A1 3/2009 Sano et al.
2009/0123172 A1 5/2009 Kishi et al.
2009/0123201 A1 5/2009 Ehara et al.
2009/0123202 A1 5/2009 Yoshinaga et al.
2009/0148204 A1 6/2009 Yoshinaga et al.
2009/0169231 A1 * 7/2009 Asakura et al. ..... 399/69
2009/0169232 A1 7/2009 Kunii et al.
2009/0238595 A1 * 9/2009 Okada ..... 399/69
2009/0245865 A1 10/2009 Shinshi et al.
2009/0317113 A1 12/2009 Kishi et al.
2010/0014880 A1 * 1/2010 Kinouchi et al. ..... 399/67
2010/0061754 A1 3/2010 Ishigaya et al.
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0239301 A1 * 9/2010 Nemoto et al. ..... 399/69
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064451 A1 3/2011 Yamaguchi et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0116848 A1 5/2011 Yamaguchi et al.
2011/0129268 A1 6/2011 Ishii et al.
2011/0142475 A1 * 6/2011 Kim ..... 399/69
2011/0150518 A1 6/2011 Hase et al.
2011/0170917 A1 7/2011 Yoshikawa et al.
2011/0176820 A1 7/2011 Kadota et al.
2011/0176822 A1 7/2011 Ishii et al.
2011/0182634 A1 7/2011 Ishigaya et al.

(56) References Cited

U.S. PATENT DOCUMENTS

| | | | |
|---|---|---|---|
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0217101 | A1 | 9/2011 | Okamoto et al. |
| 2011/0222875 | A1 | 9/2011 | Imada et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0222938 | A1 | 9/2011 | Watanabe et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274447 | A1 | 11/2011 | Arai et al. |
| 2011/0274453 | A1 | 11/2011 | Shimokawa et al. |
| 2011/0286758 | A1 | 11/2011 | Yoshinaga |
| 2011/0305485 | A1 | 12/2011 | Oshikawa et al. |

FOREIGN PATENT DOCUMENTS

| | | | |
|---|---|---|---|
| JP | 10-074023 | A | 3/1998 |
| JP | 10-161466 | A | 6/1998 |
| JP | 11-052783 | A | 2/1999 |
| JP | 2005091965 | A | 4/2005 |
| JP | 2008-070686 | A | 3/2008 |
| JP | 2009003410 | A | 1/2009 |
| JP | 2010015130 | A | 1/2010 |
| JP | 2010-096823 | A | 4/2010 |
| JP | 2010-244036 | A | 10/2010 |

* cited by examiner

FIXING DEVICE AND METHOD, AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-001841, filed on Jan. 7, 2011 in the Japanese Patent Office, the entire disclosure of which is hereby incorporated by reference herein.

FIELD OF THE INVENTION

The present invention relates to a fixing device and system and an image formation apparatus.

BACKGROUND OF THE INVENTION

Image formation apparatuses using electrophotography, such as photocopiers, printers, fax machines, etc., are well known, as disclosed for example in Japanese Patent Application Publication Nos. H10-74023 (JP-H10-74023-A) and H11-52783(JP-H11-52783-A).

To form images, such conventional apparatuses first form an electrostatic latent image on a surface of a photosensitive drum of an image bearer. The latent image is then developed into a visible image using toner as a development agent. The thus-developed image is transferred onto a sheet of recording material and is fixed thereon by a fixing device using heat and pressure to complete the image formation process.

The fixing device includes a fusing rotation member composed of opposed rollers, belts, or a combination of rollers and belts, sandwiches the recording sheet therebetween, and fuses the toner image onto the recording sheet by applying heat and pressure. The fixing device includes a heater, power supplying to which is controlled, to generate heat. The fixing device calculates a duty of electricity (i.e., a power-turn-on time period) supplied to the heater to control the temperature of the fixing device members at each control cycle. The fixing device conducts zero-crossing control based on the duty thus calculated while also performing soft-start control based on phase control to avoid abnormalities such as flicker, etc.

However, supplying a heater with power using soft-start control while gradually increasing a phase angle means that, near duties of 0% and 100%, one of the power-turn-on duties necessarily becomes discontinuous. Consequently, target temperatures cannot be maintained at duties near 0% or 100%, resulting in defective fusing. In recent years, fixing device members having a low heat capacity are used to reduce a warm-up time to save energy. As a result, control is bifurcated for the same product, with a higher duty used to start up quickly while a lower duty used only to maintain heat due to upgrading of thermal efficiency. Such an arrangement aggravates the problem of inability to maintain target temperatures at duties of near 0% and 100% described above.

BRIEF SUMMARY OF THE INVENTION

Accordingly, the present invention provides a novel fixing device that comprises an electric heater supplied with power of an input AC voltage to generate heat based on soft-start control. A temperature of the heater is controlled using multiple different power-turn-on-duty control patterns in accordance with power requirements and an operation mode of the fixing device.

In another aspect, turn on-duty to supply power to the heater is controlled based on detection of a zero-crossing point of an input voltage.

In yet another aspect, the fixing device has a fixing member heated by the heater. A temperature detector is provided to detect temperature of the fixing member. A power-turn-on time period in a duty control cycle for supplying electric power to the heater is calculated based on a relation between the temperature of the fixing member detected by the temperature detector and a target temperature. A soft-start time period for executing the soft-start control is added to the power-turn-on time period in a duty control cycle starting from the zero-crossing point of the input AC voltage when one of the multiple different control patterns is practiced. The soft-start time period is neglected when the sum of the soft-start time period and the power-turn-on time period exceeds the duty control cycle.

In yet another aspect, the soft-start time period is included in the power-turn-on time period in the duty control cycle.

In yet another aspect, the heater control includes on/off control and PID control, and the soft-start time period is added to the power-turn-on time period when the on/off control type is used.

In yet another aspect, the soft-start time period is included in the power-turn-on time period when the PID control type is used.

In yet another aspect, the type of control is switched when the operating mode is changed.

In yet another aspect, the fixing device has a flexible endless fixing member having a low heat capacity. A pipe-shaped metal heat conductor is provided in a housing in the vicinity of an inner surface of the flexible endless fixing member. A temperature detector is provided to detect the temperature of the flexible endless fixing member. The flexible endless fixing member is freely rotatable through the metal heat conductor.

In yet another aspect, there is provided an image forming apparatus having an image forming device to form a toner image and the fixing device.

In yet another aspect, there is provided a method of controlling the temperature of a fixing device comprising the steps of supplying electric power to the heater included in the fixing device by turning on/off electricity supplied thereto in a prescribed manner, and changing the electricity activation control pattern to another when the operating mode of the fixing device is changed in accordance with the electric power requirements for a given operating mode.

BRIEF DESCRIPTION OF THE DRAWINGS

A more complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
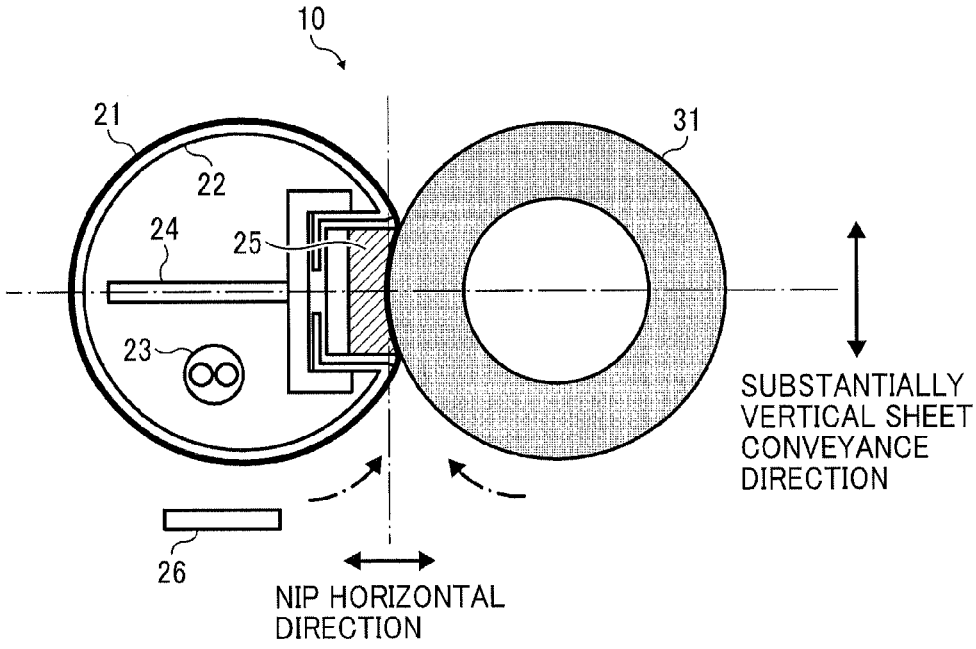
FIG. 1 is a cross-sectional view of a fixing device according to one embodiment of the present invention.

Referring now to the drawings, wherein like reference numerals designate identical or corresponding parts throughout the several views thereof and in particular to FIG. 1, a cross-sectional diagram shows the main parts of a fixing device according to various embodiments of the present invention.

Specifically, a fixing unit 10 in this figure includes a fixing belt 21, a metal pipe 22 arranged close to an inner circumferential surface of the fixing belt 21, and around which the fixing belt 21 rotates, a heater 23, and a pressure rotor 31 (in this example, a pressing roller) or the like in a fixing device housing, which is not illustrated. In the present embodiment, the heater 23 is a Halogen heater that heats the fixing belt 21 through the metal pipe 22. A temperature detector 26 is arranged near the fixing device 21.

Also held by a supporter 24 (in this example, a metal pipe) inside of a loop of the fixing device 21 is a nip formation member 25 in direct sliding contact with the inner surface of the belt 21 or indirectly sliding contact therewith via a sliding sheet (not shown).

A pressure roller 31 is pressed against and contacts the nip formation member 25 through the belt fixing device 21 and forms a fixing nip therebetween. As shown in FIG. 1, the nip has a concaved shape when seen from the side of the belt fixing device in this example. However, the nip shape is not limited thereto, and can be a flat shape or other forms, although separation of a sheet therefrom is improved with the concave shape, thereby suppressing occurrence of paper jam.

The pressure roller 31 as a pressure rotor is composed of a hollow metal roller covered by a silicone layer and a mold releasing layer (for example, a PFA or PTFE; layer) overlying the surface of the layer to obtain better releasing ability. The pressure roller 31 is driven and rotates receiving a driving force from a driving source, such as a motor, etc., through a gear, not shown, each installed in the image forming apparatus. Further, the pressure roller 31 is biased by a spring or the like, not shown, and is pressed against the belt fixing device 21, so that the rubber layer is crushed to transform and form a given nip width there. Although the pressure roller can be a solid roller, it is preferably hollow due to its required smaller heat capacity.

Optionally, the pressure roller 31 can include a heater such as a halogen heater, etc. Further, solid rubber can be used as the silicone layer. However, if the pressure roller has no heater internally, sponge rubber can be employed, because the heat insulation increases due to the sponge rubber, and heat becomes less deprived from the belt fixing device.

The belt fixing device 21 is an endless belt (or a film) made of metal, such as nickel, SUS (stainless steel), etc., or resin, such as polyimide, etc. The surface of the fixing belt has a releasing layer of a PFA or PTFE layer or the like with releasing characteristics so that toner does not adhere thereto. Between a substrate of the fixing belt and the PFA or PTFE layer, an elastic layer made of silicone rubber may be disposed. The heat capacity of the fixing belt becomes smaller if no silicone layer exists thereby improving a fixing performance. However, a slight unevenness of the belt surface is transferred putting an orange peel skin mark on a solid image when an unfixed toner image is fixed being crushed. To solve this problem, the silicone rubber layer preferably has more than 100 μm. Specifically, the silicone layer deformation absorbs the slight unevenness suppressing the orange peel skin mark image put there.

The hollow metal pipe 22 is made of metal, such as aluminum, steel, stainless steel, etc. The illustrated example of the hollow metal pipe 22 shows the pipe as circular in cross-section, although other shapes are acceptable. The pipe shaped metal body 22 may also include a supporter to support a nip section from within the pipe 22. A metal supporter 24 is disposed as shown here. At this time, when the supporter 24 is also heated by radiant heat emitted from the heater 23 of the halogen heater, surface treatment is applied to prevent such heating and suppress wasteful energy consumption. A heater 23 heating the metal pipe 22 as the metal hollow heat conduction member may be one of a halogen heater, a heating device using an IH system, a heating element, and a carbon heater or the like.

The belt fixing device 21 is rotated by an external roller. In the present embodiment, a pressure roller 31 is rotated by a driving source, which is not illustrated, and a driving force is transmitted to the belt fixing device 21 at the nip section thereby rotating the fixing belt 21. The fixing belt 21 is sandwiched and is circulated in the nip section. The Metal body 22 guides the fixing belt 21 at outside of the nip section not to separate the fixing belt 21 far from the thermal conductor (i.e., a metal pipe 22) more than a certain distance. On a boundary between the belt fixing device 21 and the metal pipe 22, lubricant, such as silicone oil, fluorinated grease, etc., is disposed. A difference in diameter between the fixing belt 21 and the pipe 22 may be within 1 mm.

Hence, with these inexpensive configurations, since warm-up is quickly completed, because the pipe shaped metal member 22 spreads and uniformly provides heat over the entire fixing belt 21, a fixing device capable of stabilizing temperature over the entire belt fixing device 21 is realized.

A fixing device having a heater 23 provided with electricity from an AC power source to generate heat (a halogen heater, in the example of FIG. 1) as described above is preferably used in an image forming apparatus, such as a photocopier, etc. As a traditional power source load in a copier with this kind of the fixing device, three types of loads (i.e., a DC power supply as an operating power supply for each device, such as a control device, etc., an exposure lamp, and a fixing heater as a heater) are exemplified. A fixing device temperature control unit to curb voltage fluctuation that especially happens when a heater 23 is turned on is disclosed in Japanese Patent Application Publication No. 5-224559 (JP-H05-224559-A). An aspect when such a fixing device temperature control device is used to control temperature of the fixing apparatus of FIG. 1 is shown in FIG. 2.

Figure 2:
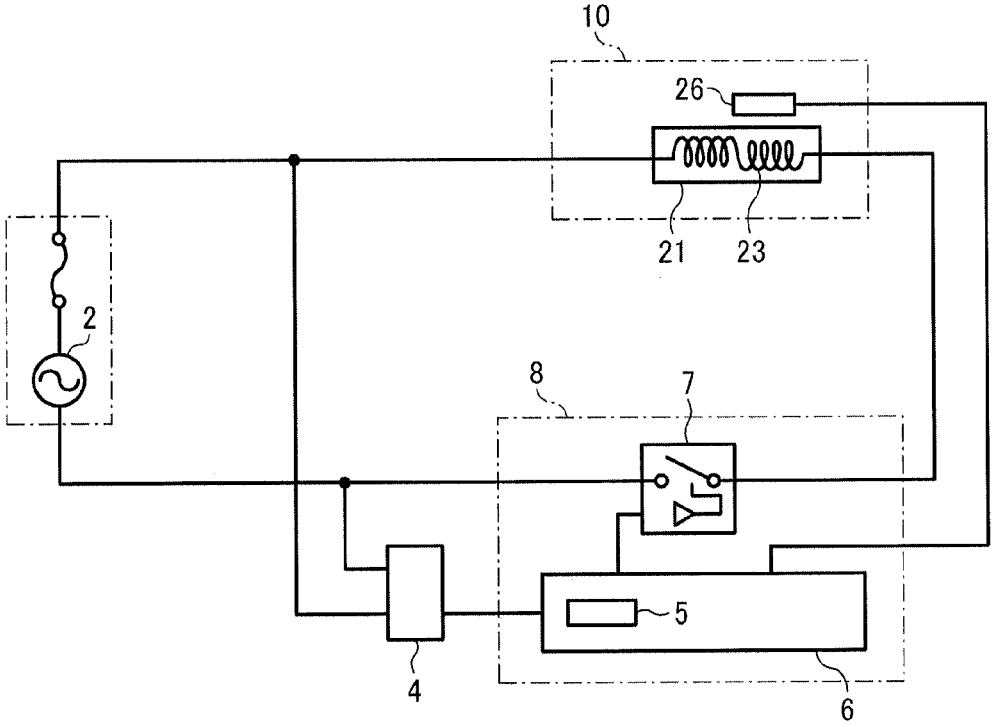
FIG. 2 is a schematic circuit diagram of a fixing control system according to one embodiment of the present invention.

In FIG. 2, reference numeral 2 represents an AC power source. Reference numeral 4 represents a zero-crossing detector to detect a zero-crossing point of an AC voltage applied to a heater 23 as a fixing heater. Reference numeral 5 represents an arithmetic processing device. Reference numeral 6 represents a control circuit including the arithmetic processing device 5. Reference numeral 7 represents an electronic switching device. Reference numeral 8 represents a control device serving as a phase control device having the control circuit 6 and an electronic switching element 7.

Figure 3:
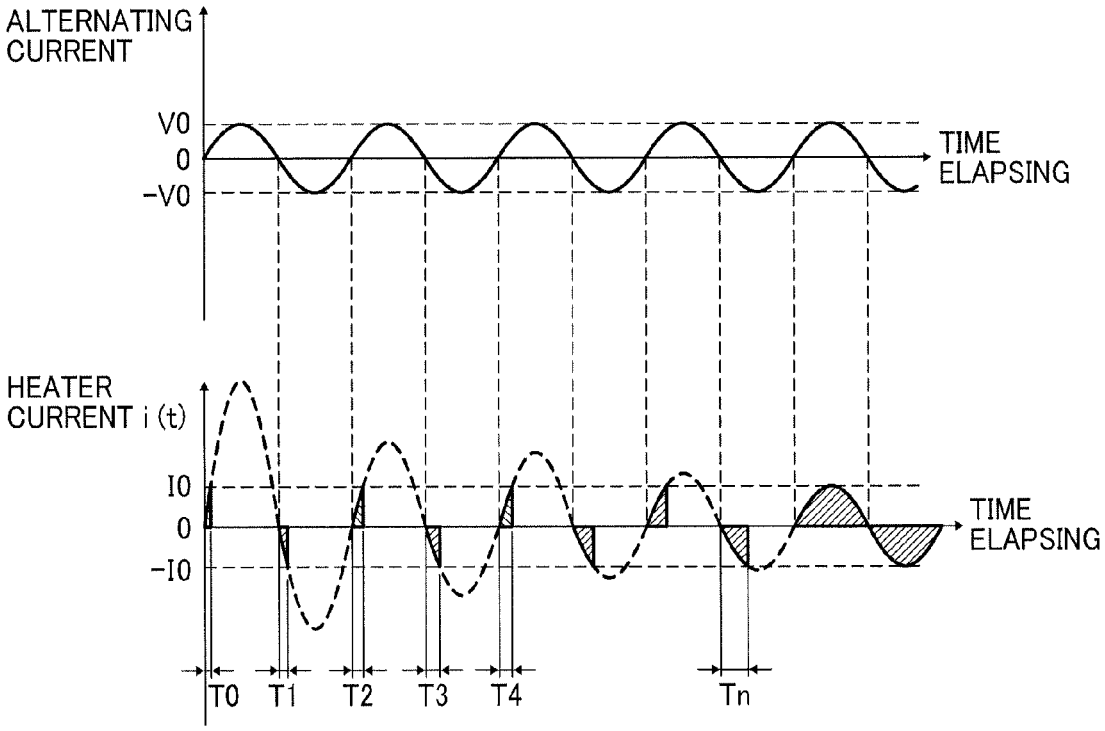
FIG. 3 illustrates electric current waveforms appearing when electric power supply starts being supplied to a heater in a soft start.

In such a configuration, an electricity turn on time Tn defined by hatching in FIG. 3 is obtained as a time period starting from when the AC voltage passes through the zero-crossing point to when a prescribed rating current (+/−10) of the heater 23 is obtained at a given temperature (e.g. approx.

180 degrees centigrade). This Tn is entered into the operation process device 5 of the control device 8, and is read therefrom every time a voltage of the heater 23 becomes zero and an interrupt signal is generated from the zero-crossing detection circuit 4 and is inputted to the operation process device 5. The control circuit 6 closes an electronic switching device 7 and energizes the heater 23 during the energizing time Tn. When the voltage of the heater 23 goes to zero, the interrupt signal is again inputted to the arithmetic processing device 5 from the zero-crossing detector 4, and the same operation as described above is done.

Electricity turn on (i.e., energizing) time Tn of heater 23 in n/2th cycle after power is turned on is represented by the following formula: $Tn=(\frac{1}{2}\pi f)\arcsin(I0\cdot Rh(tn)/V0)$, wherein F represents frequency of AC voltage, Vo repress amplitude of AC voltage, and Rh (tn) represents resistance of a heat source 23 at a time tn when amplitude of AC voltage becomes Vo level after power is turned on while the heater 23 is not controlled.

Hence, by detecting the zero-crossing point of the AC voltage when the heater 23 is energized (i.e., power is supplied thereto), the time Tn elapsing after the zero-crossing points is increased per half cycle, and thereby gradually increasingly flowing safe heater current i(t) into the heater 23. Such a soft-start control is executed until the heater current i(t) becomes a rating current (±I0). When such current flow becomes stable at the rating current (±I0), the temperature detection instrument 26 detects temperature of the heater 23 and the temperature control circuit 6 drives the switch element 7 based on the output of the temperature detection instruments 26 to set the temperature of heater 23 to a fixing possible level.

Such a phase control system used in this electricity turn on control for the heater 23 can reduce inrush current generally flown thereto and fluctuation of a voltage of the power supply occurring instantly when power is initially supplied. For the same reason, the electronic switching element 7 can only handle a small rating current, so that the control device 8 can be downsized.

Figure 4A:
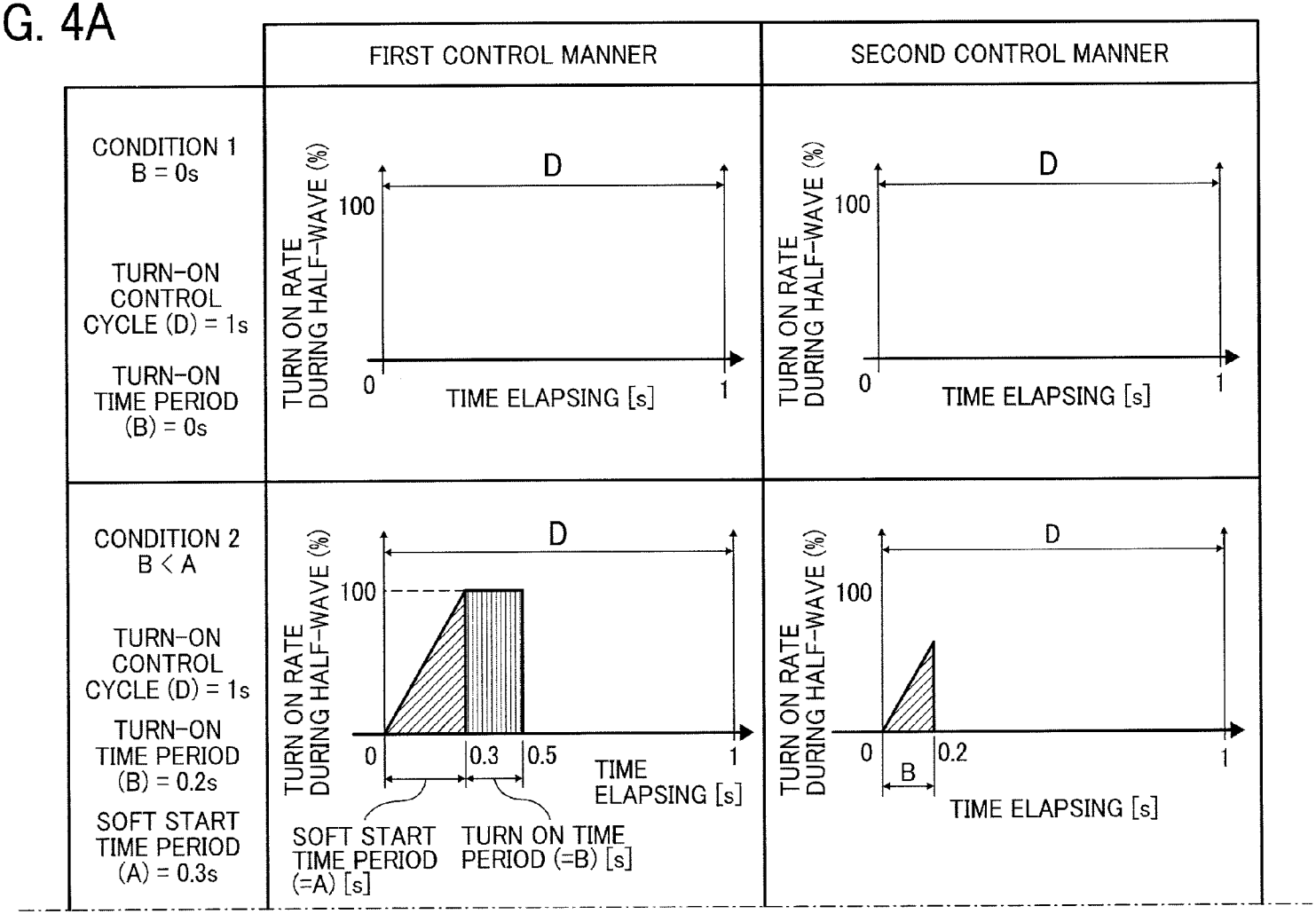
FIGS. 4A, 4B, 4C, and 4D collectively illustrate two types of heater control employed in one embodiment of the present invention.
Figure 4B:
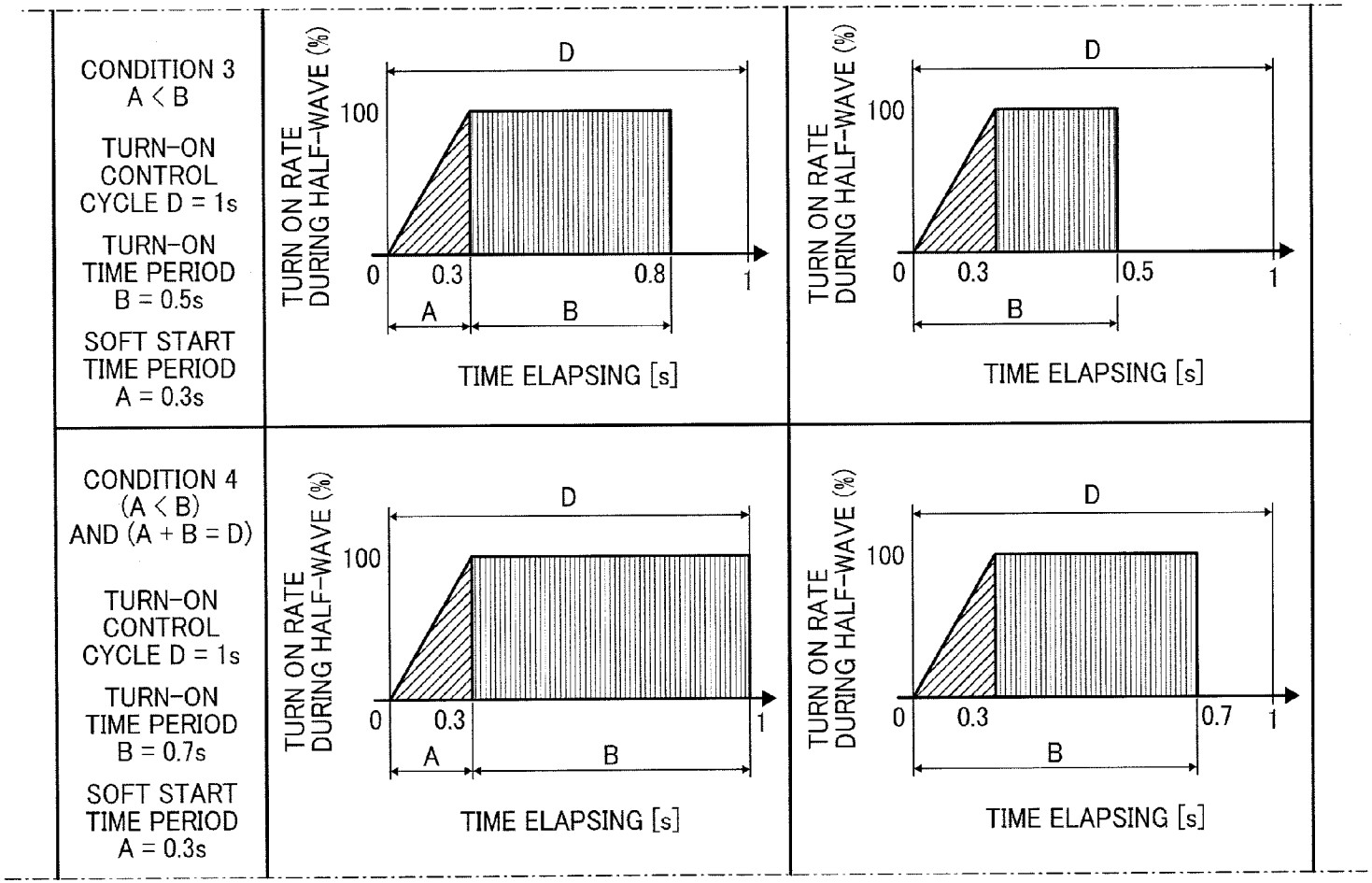
Figure 4C:
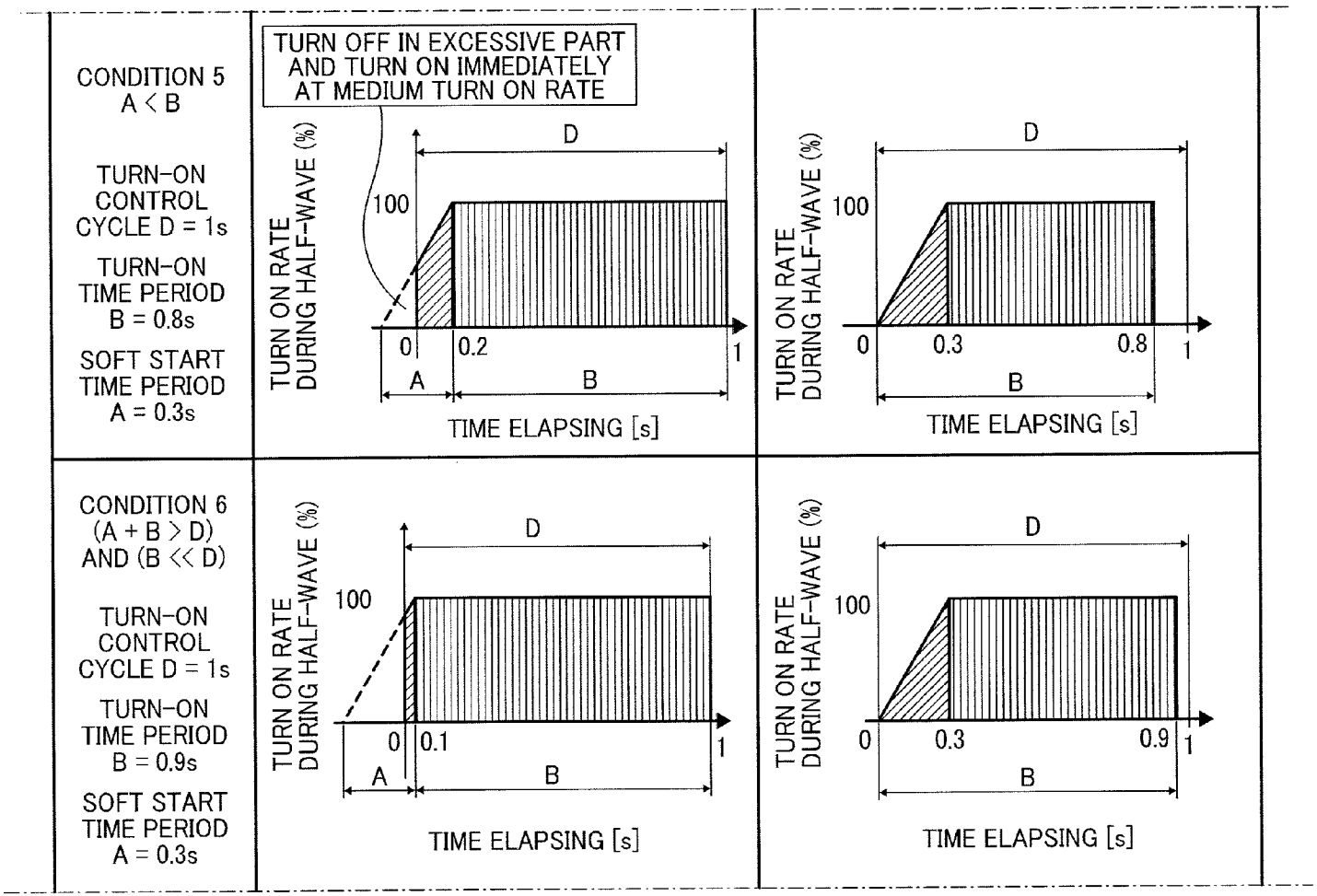
Figure 4D:
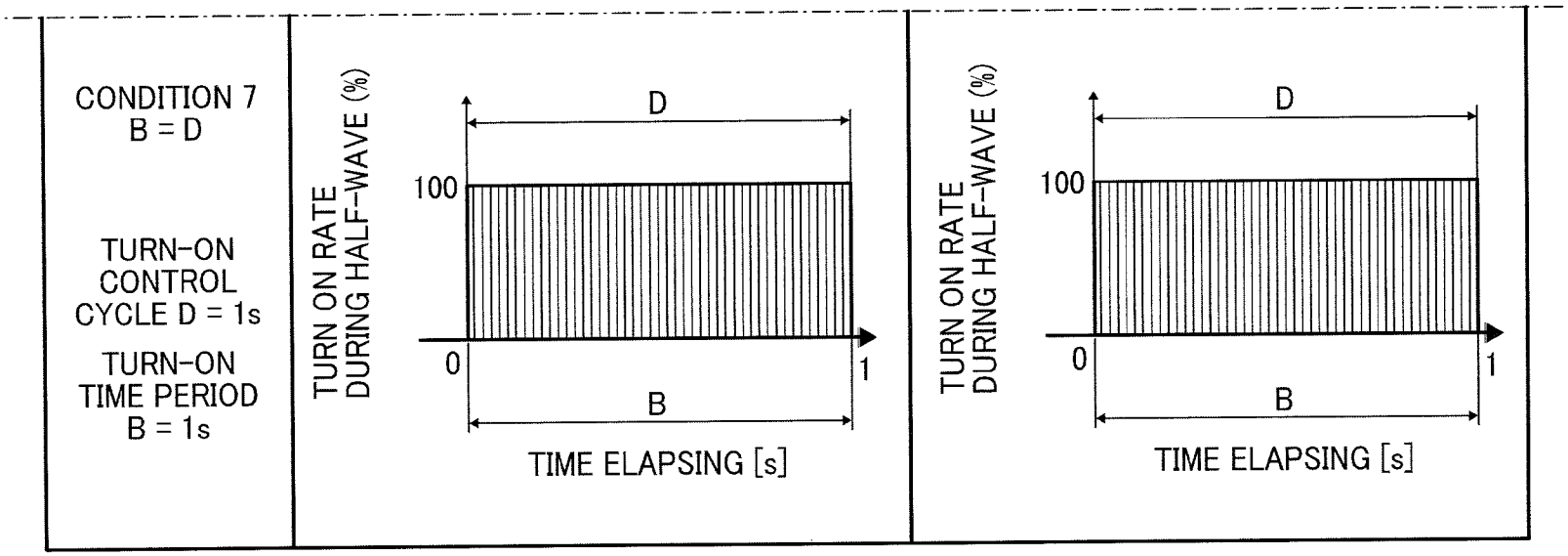

Now, one of distinctive manners of controlling a heater of a fixing device of one embodiment of the present invention is described. When a heater 23, such as halogen heater, etc., is used as a heating source of a fixing device, PID control or turn on/off control is selectively executed by a controller, such as a control circuit 6, etc., described later at a prescribed power-turn-on duty (i.e., a percentage of turning on a heater 23 in a prescribed cycle) to reach a target temperature. Specifically, a power-turn-on time period (or, a power-turn-on percentage) to supply power to the heater 23 is calculated based on a relationship between the target temperature and current temperature of the fixing device (i.e., the fixing belt 21) detected by a temperature detector 26. Then, soft start is executed to turn on the heater 23 for the purpose of suppressing inrush current. Such soft start is executed in first and second control patterns different from each other as described below with reference to FIGS. 4A and 4B.

In executing these control patterns, power is differently supplied to the heater 23 in accordance with various situations (i.e., conditions) as described below, wherein one turn-on cycle is represented by 1 s and the maximum soft-start time period (A) is 0.3 s.

For example, when a turn on time period (B) calculated based on the above-described relation is 0 s as a first situation, the heater 23 is not supplied with any power in executing each of the control patterns as shown in the up most part in the draw. When a turn on time period (B) is less than soft-start time period (A) as a second situation, the heater 23 is supplied with power at a turn on rate of about 100% for the turn on time period B of about 0.2 s in a half wave after the soft-start time period (0.3 s) is over in executing the first control pattern as shown in the second left part from the top. By contrast, the soft-start time period (A) terminates at a time 0.2 s in executing the second control pattern as shown on the second right side from the top.

When an amount of heat outputted during a control cycle of the heater, which corresponds to an area in the drawing, in executing the first situation, and that in executing the second situation are compared with each other, it is noted that a difference therebetween is greater in the first control pattern than that in the second control pattern. Thus, with the second control pattern, the amount of output heat can be continuously changed on the lower duty side due to the smaller difference.

When an inequality (A<B) is met as a third situation, the heater 23 is supplied with power at a turn on rate of about 100% for the turn on time period B of about 0.5 s in the half wave after the soft-start time period (0.3 s) is over in executing the first control pattern as in the second situation as shown in the third left part from the top. The turn on time period B of about 0.5 s for executing the second control pattern is the sum of a soft-start time period and a time period for tuning on power at the turn on rate of about 100% as shown in the third right part.

As shown in the fourth left part from the top, when the inequality (A<B) and an equality (A+B=D) are met as a fourth situation, the heater 23 is supplied with power until right the end of the control cycle in executing the first control pattern.

When an inequality (A+B>D) is met as a fifth situation, the heater 23 is supplied with power for the turn on time period B with a priority to a soft-start time period, and the soft start is executed for a remaining time period as shown in the fifth left part from the top. Specifically, an initial stage of the soft start is omitted as shown by a controller. When inequalities (A+B>D) and (B<<D) are met, the heater 23 is supplied with power for the turn on time period B with a priority to a soft-start time period, and the soft start is executed for the remaining time period in executing the first control pattern as in the fifth situation as shown in the sixth left part from the top. Accordingly, the turn on rate becomes near 100% in such a situation. For this reason, with the first control pattern, the amount of output heat can be continuously changed on the high duty side.

When an equality (B=D) is met, since the output heat changes sharply from the fifth to sixth situations in executing the second control pattern as shown in the lower most part, the amount of output heat cannot be continuously changed on the high duty side.

In any way, the above-described turn on time period B is calculated at every start of a new phase (e.g. every 1 s in FIGS. 4A and 4B) to be used in the next turn on control cycle based on target and detected temperatures. The above-described soft start takes 0.3 s and the turn on rate thereof gradually linearly changes at the same rate as shown in a triangle sec shown in FIGS. 4A and 4B. Further, in the sixth and seventh situations in executing the first control pattern, since the sum of the A and B exceeds the turn on control cycle, the initial part of the soft start is omitted. Whereas in executing the second control pattern, since the soft-start time period A is shorter than the turn on time period B, the power is turned off when the soft start is executed for the turn on time period B.

Specifically, a first control pattern can continuously change an output on the side of high Duty. By contrast, an output is suddenly lost when it is less than or equal to a prescribed level on the low Duty side, so that temperature control is difficult due to its discontinuity. In a second control pattern, the output can be continuously changed on the low duty side, and temperature control is difficult on the high Duty side due to its discontinuity. Therefore, one of two control patterns is optionally chosen in accordance with a range so that temperature control can be easily performed in this embodiment. Specifically, the first control pattern is adopted during the turn on/off control, such as a standby mode, a start-up mode, etc., in which precise control is needed on the high Duty side. Whereas, the second control pattern of the soft-start option is adopted during the PID control, such as a sheet feed mode, etc., in which exactly precise control is needed on the low-Duty-side.

Figure 5:
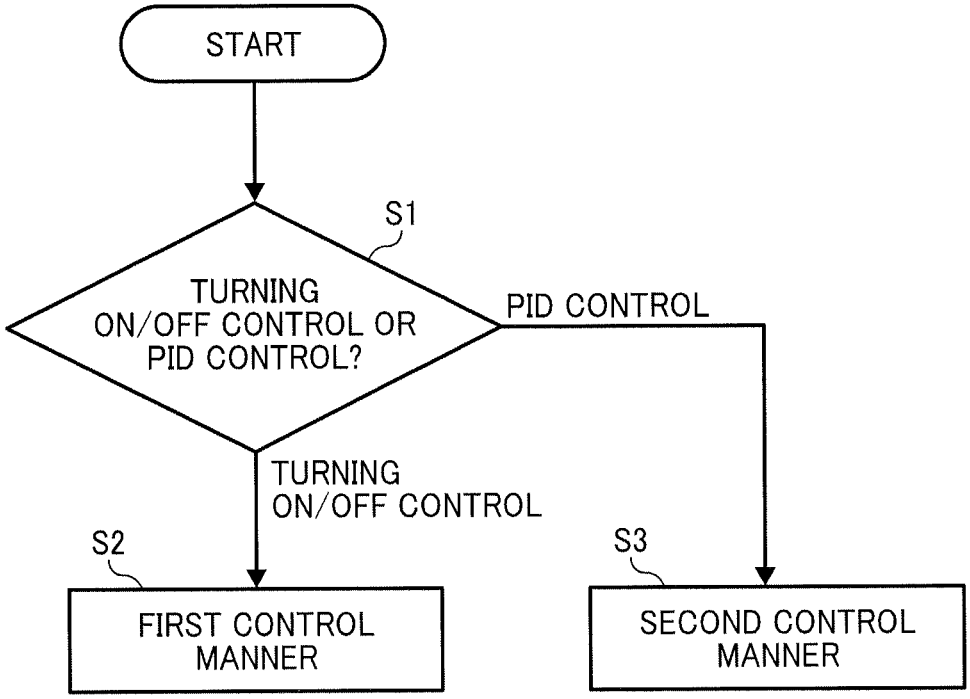
FIG. 5 is a flow chart illustrating sequences implemented in the two types of heater control, respectively, according to one embodiment of the present invention.

FIG. 5 is a flowchart that illustrates switching processing executed in the second control pattern. That is, it is initially determined whether the soft-start pattern is either the PID control or the turn on/off control implemented when a fixing heater 23 starts lighting in step S1. If the determination specifies the turn on/off control, the sequence proceeds to step S2 and the heater 23 is heated using the soft start of the first control pattern. On the other hand, if it specifies the PID control, the sequence goes to a step S3, and the heater 23 is heated by the soft-start control according to the second control pattern.

A difference between these control patterns in this situation is shown below in

TABLE 1

| Warm up Time Period | | | | Temperature Ripple | | | |
|---|---|---|---|---|---|---|---|
| | | | | | Average Duty | | |
| Input Voltage | Duty | First Control Pattern | Second Control Pattern | Sheet Type | During Sheet Passage | First Control Pattern | Second Control Pattern |
| 100 v | 95% | 9 sec | 15 sec | First Type | 10% | 10° C. | 3° C. |
| 95 v | 100% | 10 sec | 10 sec | Second Type | 16% | 3° C. | 2° C. |
| 105 v | 90% | 10 sec | 16 sec | Third Type | 4% | 21° C. | 2° C. |

As noted from the table 1, a warm-up time period required for the first control pattern is quickly stabilized. Whereas, a variation goes on the second control pattern depending on the duty. In addition, a change in temperature is suppressed during the sheet passage in the second control pattern, whereas temperature ripple grows depending on the duty in the first control pattern.

Accordingly, when it is intended to control power supply in a power-turn-on duty of around 0% for a mode only requiring small energy, such as a sheet passage mode (i.e., a copying mode), etc., a second control pattern incorporating a soft-start time period within an power-turn-on time period is used, and the soft-start for heating the heater 23 is executed. As a result, electrical power is continuously supplied in such an electric power area due to the soft start during power supply control at the low-power-turn-on rate. As a result, temperature of fixing device member can be controlled as aimed not affected by temperature control.

Further, when it is intended to control in a power-turn-on rate of near 100% for a mode requiring great electric power, such as a standby mode, a start-up mode, etc., a first control pattern that adds the soft-start time period to the power-turn-on time period is used. Hence, electrical power is continuously supplied in an electric power area of the high duty. As a result, temperature of fixing device member can be controlled as aimed not affected by the temperature control.

Hence, the warm-up time period is quickly settled reducing temperature ripple during passage of a sheet. That is, conflicting requests (i.e., decrease in warm-up time period and reduction of temperature ripple) can be realized at the same time.

It is preferable that both control patterns are switched and one of the turn on/off control and the PID control is optionally used per mode, such as a copy mode, a standby mode, etc., when changed. Further, it is preferable that a power-turn-on duty of the previous cycle used in feeding back calculation is stipulated from a difference between the target and the current temperature degrees when a control manner is switched to the PID control from the turn on/off control. Hence, control disturbance can be suppressed and a temperature of the heater 23 (i.e. a fixing member) can be highly precisely controlled as aimed. Accordingly, a stable and high image quality can be obtained.

As discussed heretofore, according to the present invention, as a soft-start pattern executed when the heater 23 is supplied with power, a different power-turn-on control is used depending on an amount of power necessary for each of control modes (operating modes) of the fixing device. Consequently, heater 23 control is optimized and temperature of the fixing member can be highly precisely controlled regardless of the control mode. Further, stable image quality can be obtained preventing fixing malfunction at power-turn-on duties near 0% and 100% when executing phase control.

Figure 6:
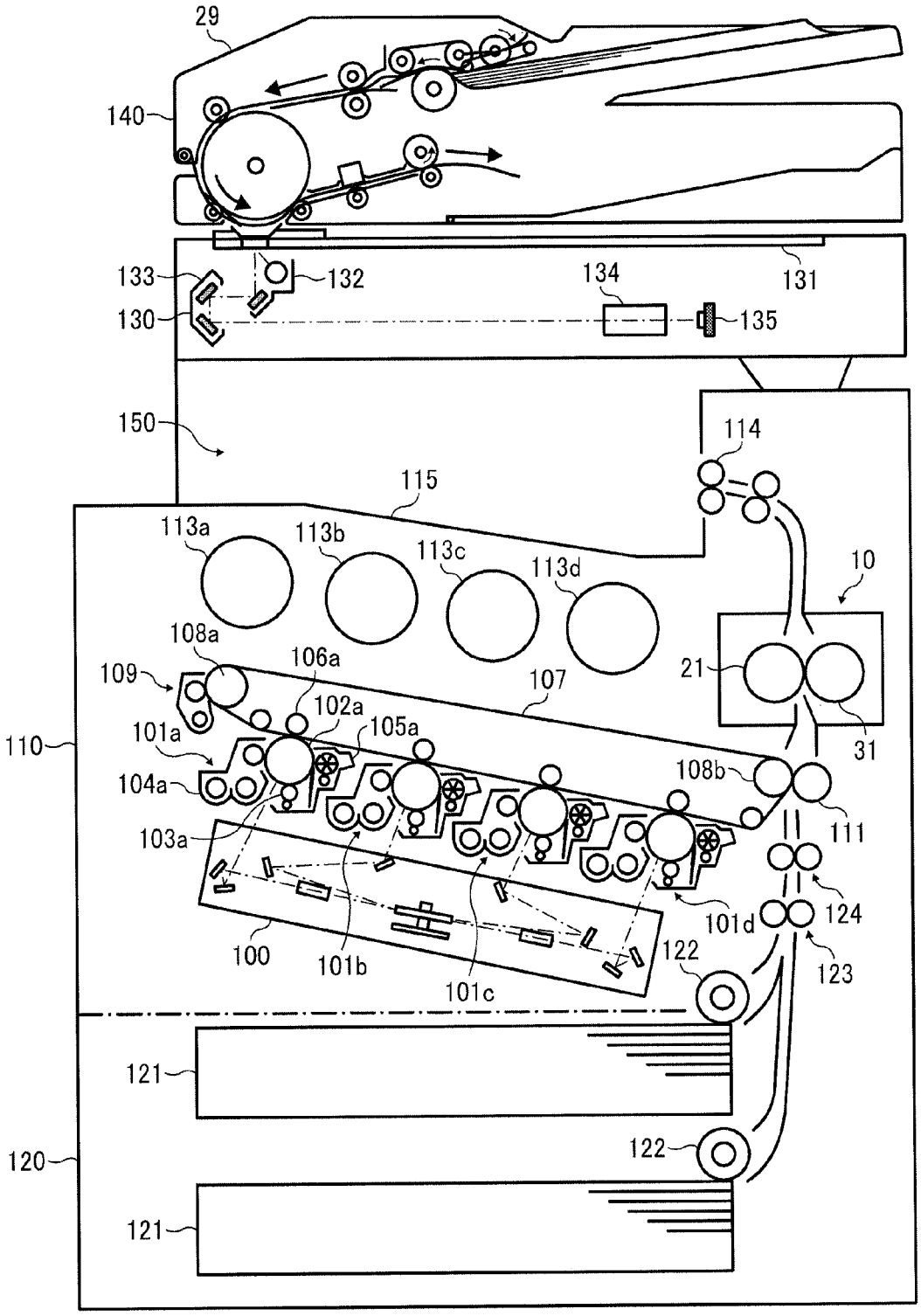
FIG. 6 is a cross sectional view illustrating one example of an image forming apparatus equipped with the fixing device according to one embodiment of the present invention.

With reference to FIG. 6, one example of an image formation device with the fixing device according to one embodiment of the present invention is described. A copier as shown in FIG. 6 is composed of an image formation unit 110, a sheet feeding unit 120, an image recognition unit 130, and an automatic document feeding device 140. Among the image formation unit 110 and the image recognition unit 130, there is disposed an inner sheet ejection unit 150.

The image formation unit 110 employs a tandem system arranging four image formation unit 101 (*a, b, c, d*) almost at the center thereof to form a full-color image. Each of the image formation units 101 (*a, b, c, d*) forms a component color image of yellow, magenta, cyan, and black. Each of the image forming units 101 (*a, b, c, d*) is arranged parallel to each other along a lower running side of an intermediate transfer belt 107. The Intermediate transfer belt 107 is wound around supporting rollers 108*a* and 108*b* and is circulated counter clockwise in the drawing. At an outside of the left side supporter 108*a*, a cleaning unit 109 is located to clean the intermediate transfer belt 107. Above the intermediate transfer belt 107, there is provided multiple toner bottles 113 (*a, b, c, d*) to accommodate respective color for particles to be replenished to developing devices of the image formation units.

Each image formation unit 101 (*a, b, c, d*) has the same configuration employing different color toner to handle. Herein below, various devices in the image formation unit 101 are described omitting the suffixes of a, b, c, and d. The image formation unit 101 includes a photoconductive drum 102 as an image bearer. Around the photoconductive drum 102, a developing device 104, a cleaning device 105, and a charging device 103 or the like are disposed. Further, a transfer roller 106 is disposed opposed to the photo-conductive drum 102 at inside of a loop of the intermediate transfer belt 107 as a primary transfer device. Each of the image formation units 101 is detachably attached to an apparatus body as a process cartridge.

Below the four image formation units 101, an optical writing apparatus 100 is disposed. The optical writing device 100 emits a laser light as a scanning light to each of surfaces of the photoconductive drums 102 of the color image formation units.

Below the image formation unit 110, a sheet feeding unit 120 of a sheet feed tray 12 loading multiple sheets is disposed. A sheet feed roller 122 is disposed on the right side of the sheet tray 121 and sends out sheets loaded in the tray one by one.

A pair of conveyance rollers 123 and a pair of registration rollers 124 are disposed downstream of the sheet feed roller 122 in a sheet transport direction. Further, above the pair of registration rollers 124, a roller transfer roller 111 as a secondary transfer device is disposed being opposed to a belt support roller 108*b* serving as a transfer opposed roller.

Above a secondary transfer section, the fixing unit 10 is located. The fixing unit 10 fuses a not-fixed toner image transferred onto a sheet at the secondary transfer section by applying heating and pressure thereto. Above the fixing device 10, a sheet ejection roller 114 is disposed to eject a sheet with a fixed toner image thereon onto a sheet exit tray 115 of the inner sheet ejection unit 150.

Above the image formation unit 110, a reading unit 130 is located across the inner sheet ejection unit 150. The reading unit 130 includes a first carriage member 132 having a manuscript lighting use light source and a first mirror, and a second carriage 133 having second and third mirrors to read a manuscript (not shown) loaded on a contact glass 131. Image information obtained from the document by scanning with the first and second carriage members 132 and 133 is subsequently read by a CCD 135 located behind a lens 134 as an image signal and is digitized by applying image processing. In accordance with the image signal subjected to the image processing, the light source of the optical scanning device 100 emits and scans light and forms a latent image on the surface of the photoconductor 102.

An automatic manuscript feeding device (ADF) 140 is mounted on a reading unit 130. The ADF 140 sends manuscripts set on a manuscript tray one by one. The first and second carriages 132 and 133 stopping at prescribed sections scan and read the manuscript being conveyed in the reading unit 130. Beside the image formation based on the information read from the manuscript in the reading unit 130, an image can be formed based on image information transmitted from external devices, such as personal computers, etc.

Now, an image formation behavior of a copier with the above-described device is briefly described. The photoconductive drum 102 of the above described image formation unit 101 is driven and rotated clockwise in the drawing by a driving device not illustrated. Then, the surface of the photoconductive drum 102 is uniformly charged by a charging device 103 with a given pole. The thus charged photosensitive surface receives a laser light from the optical writing device 100 thereby forming a latent image thereon. When a color image is formed, image information included in exposure light emitted to each photoconductive drum 102 is decomposed color information of yellow, magenta, cyan, and black monochromatic image information pieces. Each color toner is supplied from the developing device 104 to latent electrostatic images thus formed, so that the latent images are visualized as toner images.

Further, the intermediate transfer belt 107 is driven and circulated counterclockwise in the drawing. Then, each color toner image is transferred and overlaid on the intermediate transfer belt 107 from each of the photoconductive drums 102 by a function of each of the primary transfer rollers 106 one by one in each of the image formation units 101. Consequently, the intermediate transfer belt 107 bears the full-color toner image surface thereon.

Further, a monochromatic image can be formed only using one of image formation units 101 or dual or a triple color image also can be formed. When a black and white print is generated, only the rightmost side Bk unit (101*d*) in the figure is used among the four process cartridges. Subsequently, residual toner adhering to the surface of the photoconductive drum after the transferring process transferring the toner images is removed therefrom.

Then, the surface of the photoconductive drum is initialized by a static electricity eliminator and prepares for the next image formation.

On the other hand, a sheet fed from the sheet tray 121 is conveyed by a pair of registration rollers 124 toward the secondary transfer section synchronizing with a toner image borne on the intermediate transfer belt 107. The toner image on the surface of the intermediate transfer belt is transferred onto the sheet at once by a function of the secondary transfer roller 111. The toner image on the sheet is fused and fixed thereon when passing through the fixing unit 10 by heat and pressure. The sheet with the fused toner image is then ejected onto the exit tray 115 by the exit roller 114.

The present invention is not limited to the above-described various examples. For example, the fixing device is not limit to the belt fixing device type and can optionally employ a heat roll system. Further, the heater 23 is not limited to the halogen Heater and can employ a heating device employing an IH system, a carbon heater, and a heat resistance or the like. A sheet feed direction of the fixing device is not limit to a vertical one. A fixing device control device can employ an appropriate configuration as well.

Further, the configuration of the image formation device is optionally chosen. Further, an order of arrangement of respective color process cartridges in the tandem state may be optionally determined. Further, it is not limited to just the tandem system and can employ a system, in which several developing devices are disposed around one photosensitive body, or a revolver developer apparatus as well. Further, the present invention is also applied to a full-color machine using a triple color toner particles, a multi-color presses using twin color toner, and a black and white color machine as well. Of course, the image forming apparatus is not limited to just a copier and a multifunction printer, facsimile, or a multiple functional machine combining these functions can be employed.

According to the fixing device, the image forming apparatus, and the control system of the fixing device of one embodiment of the present invention, since the heater 23 of the fixing apparatus is controlled in accordance with an amount of power needed to an operating mode, the heater 23 can be excellently controlled regardless of the control mode while highly precisely controlling temperature of a fixing member. The embodiment can also prevent fixing malfunction at power-turn-on duties near 0% and 100% when phase control is executed, thereby high quality and stable image can be obtained.

According to another aspect, inrush current can be reduced with zero-crossing control, so that the heater 23 can prolong its life. According to yet another aspect, temperature control can be precise even on the high Duty side.

According to yet another aspect, temperature control can be again precise on the low Duty side. Further, soft-start control can be optimized and temperature control can be highly precise during the turn on/off control in which the high Duty side control is expected to be highly precise.

According to yet another aspect, soft-start control can be optimized and temperature control can be highly precise during the PID control in which the low Duty side control is expected to be highly precise.

According to yet another aspect, stable temperature control is obtained by switching the control pattern when an operation mode is changed. According to yet another aspect, even when heat capacity of the fixing member is small and is sensitive to a change in electricity turn on duty, deterioration of members can be prevented by enabling high-precision temperature control.

Numerous additional modifications and variations of the present invention are possible in light of the above teachings. It is therefore to be understood that within the scope of the appended claims, the present invention may be practiced otherwise than as specifically described herein.

What is claimed is:

1. A fixing control system comprising:

a fixing device including a heater configured to receive power of an input AC voltage during a power-turn-on time period to generate heat, said power being supplied under soft-start control;

a control circuit including a processor configured to control the heater in accordance with power requirements of the fixing device using at least two different power-turn-on-duty control patterns in accordance with an operation mode of the fixing device such that in a first one of the different power-turn-on-duty control patterns, a soft-start procedure is utilized during a soft-start time period at power-turn-on time in a duty control cycle starting from a zero-crossing of the input AC voltage if a sum of the soft-start time period and the power-turn-on time period does not exceed the duty control cycle, and if the sum of the soft-start time period and the power-turn-on time period exceeds the duty control cycle, the soft start procedure is delayed from the power-turn-on time to a time sufficient to complete the power-turn-on time period within the duty control cycle and the soft-start procedure is begun at an increased duty cycle.

2. The fixing control system as claimed in claim 1, wherein the controller is configured to supply power at a power-turn-on duty based on detection of the zero-crossing point of the input AC voltage.

3. The fixing control system as claimed in claim 1, wherein the fixing device includes, a fixing member configured to be heated by the heater; and a temperature detector configured to detect a temperature of the fixing member, wherein the power-turn-on time period in the duty control cycle for supplying power to the heater is calculated based on a relation between the temperature of the fixing member detected by the temperature detector and a target temperature, and a power-turn-on duty of the power supplied to the heater is controlled based on detection of the zero-crossing point of the input AC voltage applied to the heater.

4. The fixing control system as claimed in claim 3, wherein said at least two different power-turn-on-duty control patterns include an on/off control pattern and a Proportional Integral Differential (PID) control pattern, and the first one of the at least two different power-turn-on-duty control patterns is the turn on/off control pattern.

5. The fixing control system as claimed in claim 1, wherein the fixing device includes, a fixing member configured to be heated by the heater; and a temperature detector configured to detect temperature of the fixing member, wherein the power-turn-on time period in the duty control cycle for supplying power to the heater is calculated based on a relation between the temperature of the fixing member detected by the temperature detector and a target temperature, and a power-turn-on duty of the power supplied to the heater is controlled based on detection of the zero-crossing point of the input AC voltage applied to the heater.

6. The fixing control system as claimed in claim 4, wherein said at least two different power-turn-on-duty control patterns include an on/off control system and a Proportional Integral Differential (PID) control pattern, and a second one of the at least two different power-turn-on-duty control patterns is the PID control pattern.

7. The fixing control system as claimed in claim 1, wherein the control circuit is configured to switch between said at least two different power-turn-on-duty control patterns when the operation mode of the fixing device is changed.

8. The fixing control system as claimed in claim 1, further comprising:

a flexible endless fixing member having a low heat capacity;

a pipe-shaped metal heat conductor secured to a housing in the vicinity of an inner surface of the flexible endless fixing member, around which the flexible endless fixing member is freely rotatable; and a temperature detector configured to detect a temperature of the flexible endless fixing member.

9. An image forming apparatus comprising:

an image forming device to form a toner image;

a fixing device including a heater configured to receive power of an input AC voltage during a power-turn-on time period to generate heat, a control circuit including a processor configured to control the heater using at least two different control systems in accordance with power requirements in the fixing device per operation mode such that in a first one of the different control systems, a soft-start procedure is utilized during a soft-start time period at power-turn-on time in a duty control cycle starting from a zero-crossing of the input AC voltage if a sum of the soft-start time period and the power-turn-on time period does not exceed the duty control cycle, and if the sum of the soft-start time period and the power-turn-on time period exceeds the duty control cycle, the soft start procedure is delayed from the power-turn-on time to a time sufficient to complete the power-turn-on time period within the duty control cycle and the soft-start procedure is begun at an increased duty cycle.

10. The image forming apparatus as claimed in claim 9, wherein a power-turn-on duty for supplying power to the heater is controlled based on detection of the zero-crossing point of an input AC voltage applied to the heater.

11. The image forming apparatus as claimed in claim 9, wherein the fixing device includes, a fixing member configured to be heated by the heater; and a temperature detector configured to detect a temperature of the fixing member, wherein the power-turn-on time period in the duty control cycle for supplying power to the heater is calculated based on a relation between the temperature of the fixing member detected by the temperature detector and a target temperature, and a power-turn-on duty of the power supplied to the heater is controlled based on detection of the zero-crossing point of the input AC voltage applied to the heater.

12. The image forming apparatus as claimed in claim 9, wherein said at least two different control systems include an on/off control system and a Proportional Integral Differential (PID) control system, and the first one of the at least two different control systems is the turn on/off control system.

13. The image forming apparatus as claimed in claim 9, wherein the fixing device includes, a fixing member configured to be heated by the heater; and a temperature detector configured to detect a temperature of the fixing member, wherein the power-turn-on time period in the duty control cycle for supplying power to the heater is calculated based on a relation between the temperature of the fixing member detected by the temperature detector and a target temperature, and a power-turn-on duty of the power supplied to the heater is controlled based on detection of the zero-crossing point of the input AC voltage applied to the heater.

14. The image forming apparatus as claimed in claim 9, wherein said at least two different control systems include an on/off control system and a Proportional Integral Differential (PID) control system, and a second one of the at least two different control systems is the PID control system.

15. The image forming apparatus as claimed in claim 9, wherein said at least two different control systems are switched therebetween when the operation mode of the fixing device is changed.

16. The image forming apparatus as claimed in claim 9, further comprising:

a flexible endless fixing member having a low heat capacity;

a pipe-shaped metal heat conductor secured to a housing in the vicinity of an inner surface of the flexible endless fixing member, around which the flexible endless fixing member is freely rotatable; and a temperature detector configured to detect temperature of the flexible endless fixing member.

17. A method of controlling temperature of a fixing device including a heater supplied with power of an input AC voltage during a power-turn-on time period to generate heat, the method comprising:

detecting a temperature of the heater;

calculating a power-turn-on time period in a duty control cycle for supplying power to the heater based on a relation between the temperature of the fixing member and a target temperature;

controlling the heating in accordance with power requirements of the fixing device and a result of the calculation using at least two different power-turn-on-duty control patterns in accordance with an operation mode of the fixing device such that in a first one of the different power-turn-on-duty control patterns the method includes, performing a soft-start procedure during a soft-start time period at power-turn-on time in a duty control cycle starting from a zero-crossing of the input AC voltage if a sum of the soft-start time period and the power-turn-on time period does not exceed the duty control cycle, and if the sum of the soft-start time period and the power-turn-on time period exceeds the duty control cycle, delaying the soft start procedure from at the power-turn-on time to a time sufficient to complete the power-turn-on time period within the duty control cycle and the soft-start procedure is begun at an increased duty cycle.

18. The method as claimed in claim 17, further comprising:

incorporating the soft-start control time period for executing the soft start to the power-turn-on time period in the duty control cycle starting from the zero-crossing point of the input AC voltage; and controlling power supply to the heater based on a result of the incorporation when the operation mode is changed.

* * * * *